US009027506B2

(12) United States Patent
Fulkerson et al.

(10) Patent No.: US 9,027,506 B2
(45) Date of Patent: May 12, 2015

(54) DENSE PHASE POWDER COATING SYSTEM FOR CONTAINERS

(75) Inventors: Terrence M. Fulkerson, Brunswick Hills, OH (US); Brian D. Mather, North Olmsted, OH (US)

(73) Assignee: Nordson Corporation, Westlake, OH (US)

( * ) Notice: Subject to any disclaimer, the term of this patent is extended or adjusted under 35 U.S.C. 154(b) by 269 days.

(21) Appl. No.: 13/098,640

(22) Filed: May 2, 2011

(65) Prior Publication Data

US 2012/0282398 A1 Nov. 8, 2012

(51) Int. Cl.

| | |
|---|---|
| ***B05C 19/00*** | (2006.01) |
| ***B05C 11/10*** | (2006.01) |
| ***B05B 1/30*** | (2006.01) |
| ***B05B 1/14*** | (2006.01) |
| ***B05B 1/26*** | (2006.01) |
| ***B05B 5/03*** | (2006.01) |
| ***B05B 5/12*** | (2006.01) |
| ***B05B 5/16*** | (2006.01) |
| ***B05B 15/04*** | (2006.01) |

(52) U.S. Cl.

CPC ..... *B05B 1/3093* (2013.01); *B05B 1/14* (2013.01); *B05B 1/265* (2013.01); *B05B 5/032* (2013.01); *B05B 5/12* (2013.01); *B05B 5/1683* (2013.01); *B05B 15/0412* (2013.01)

(58) Field of Classification Search

CPC ..... B05C 19/00; B05C 19/007; B05C 19/06; B05B 15/0412; B05B 1/3092; B05B 5/12; B05B 5/032

USPC ..... 118/308, 309, 683, 684; 239/589, 239/596–598; 427/180

See application file for complete search history.

(56) References Cited

U.S. PATENT DOCUMENTS

| | | | |
|---|---|---|---|
| 3,558,052 | A | 1/1971 | Dunn |
| 3,901,184 | A | 8/1975 | Payne et al. |
| 4,165,134 | A | 8/1979 | Payne |
| 4,314,669 | A | 2/1982 | Moos |

(Continued)

FOREIGN PATENT DOCUMENTS

| | | |
|---|---|---|
| GB | 662 908 | 12/1951 |
| GB | 2 289 743 | 11/1995 |

(Continued)

OTHER PUBLICATIONS

International Search Report dated Aug. 16, 2012, for International Application No. PCT/US2012/034875.

(Continued)

*Primary Examiner* — Yewebdar Tadesse

(74) *Attorney, Agent, or Firm* — Calfee, Halter & Griswold LLP

(57) ABSTRACT

A dense phase powder coating system includes a powder supply, dense phase pump, a spray gun and a diverter valve that can be used to select between conveying powder to the spray gun or circulating the powder back to the powder supply. The diverter valve may include two pneumatically actuate valve members. In one embodiment, the powder spray gun applies powder coating material to inside surfaces of a tubular container. A spray nozzle concept also is presented having a nozzle body with a conical deflector. The spray nozzle provides an uninterrupted flow between spray nozzle outlet holes and a deflector surface. The deflector may be integrally machined with the nozzle body to provide a one piece spray nozzle.

14 Claims, 8 Drawing Sheets

(56) References Cited

U.S. PATENT DOCUMENTS

| | | | | |
|---|---|---|---|---|
| 4,399,945 | A | 8/1983 | Ruud | |
| 4,401,275 | A | 8/1983 | Ruud | |
| 4,927,346 | A | 5/1990 | Kaiser et al. | |
| 5,173,325 | A | 12/1992 | Knobbe et al. | |
| 5,279,854 | A * | 1/1994 | Kendall et al. | 427/197 |
| 5,474,609 | A | 12/1995 | Mulder et al. | |
| 7,882,797 | B2 * | 2/2011 | Forsbring | 118/308 |
| 2005/0126476 | A1 | 6/2005 | Shutic et al. | |
| 2005/0178325 | A1 * | 8/2005 | Herre et al. | 118/308 |
| 2005/0229845 | A1 * | 10/2005 | Mather et al. | 118/308 |
| 2005/0279860 | A1 | 12/2005 | Fulkerson et al. | |
| 2009/0074960 | A1 * | 3/2009 | Forsbring | 427/197 |

FOREIGN PATENT DOCUMENTS

| | | |
|---|---|---|
| WO | 2005/018823 | 3/2005 |
| WO | 2008/084095 | 7/2008 |
| WO | 2008/140663 | 11/2008 |
| WO | 2009/027805 | 3/2009 |
| WO | 2009/037541 | 3/2009 |
| WO | 2009/050298 | 4/2009 |
| WO | 2010/077936 | 7/2010 |
| WO | 2010/125282 | 11/2010 |

OTHER PUBLICATIONS

Written Opinion dated Aug. 16, 2012, for International Application No. PCT/US2012/034875.

International Preliminary Report on Patentability dated Nov. 5, 2013, for corresponding International Application Serial No. PCT/US2012/034875.

* cited by examiner

DENSE PHASE POWDER COATING SYSTEM FOR CONTAINERS

TECHNICAL FIELD OF THE INVENTION

The invention relates generally to material application systems, for example but not limited to powder coating material application systems. More particularly, the invention relates to applying powder coating material to surfaces of tubular containers such as cans, for example.

BACKGROUND OF THE INVENTION

Material application systems are used to apply one or more materials in one or more layers to an object. General examples are powder coating systems, as well as other particulate material application systems such as may be used in the food processing and chemical industries. These are but a few examples of a wide and numerous variety of systems used to apply particulate materials to an object and to which the present invention can be used.

Known supply systems for powder coating materials generally involve a container such as a box or hopper that holds a fresh supply of new or 'virgin' powder. This powder is usually fluidized within the hopper, meaning that air is pumped into the powder to produce an almost liquid-like bed of powder. Fluidized powder is typically a rich mixture of powder to air ratio. Often, recovered powder overspray is returned to the supply via a sieve arrangement. A Venturi pump may be used to draw powder through a suction line or tube from the hopper into a feed hose and then to push the powder under positive pressure through the hose to a spray gun.

There are two generally known types of dry particulate material transfer processes, referred to herein as dilute phase and dense phase. Dilute phase systems utilize a substantial quantity of air to push material through one or more hoses from a supply to a spray applicator. A common pump design used in powder coating systems is the Venturi pump which introduces a large volume of air at higher velocity into the powder flow. In order to achieve adequate powder flow rates (in pounds per minute or pounds per hour for example), the components that make up the flow path must be large enough to accommodate the flow with such a high air to material ratio (in other words lean flow) otherwise significant back pressure and other deleterious effects can occur.

Dense phase systems on the other hand are characterized by a high material to air ratio (in other words rich flow). A dense phase pump is described in pending U.S. patent application Ser. No. 10/501,693 filed on Jul. 16, 2004 for PROCESS AND EQUIPMENT FOR THE CONVEYANCE OF POWDERED MATERIAL, the entire disclosure of which is fully incorporated herein by reference, and which is owned by the assignee of the present invention. This pump is characterized in general by a pump chamber that is partially defined by a gas permeable member. Material, such as powder coating material as an example, is drawn into the chamber at one end by gravity and/or negative pressure and is pushed out of the chamber through an opposite end by positive air pressure. This pump design is very effective for transferring material, in part due to the novel arrangement of a gas permeable member forming part of the pump chamber.

An example of a dense phase powder coating system is also described in U.S. Patent Application Publication No. 2005/0126476 A1 published on Jun. 16, 2005, the entire disclosure of which is fully incorporated herein by reference. This disclosure describes a dense phase pump, as well as other system components including a spray gun, recovery system and control system, all of which may be but need not be used in the exemplary embodiments herein.

Many known material application systems utilize electrostatic charging of the particulate material to improve transfer efficiency. One form of electrostatic charging commonly used with powder coating material is corona charging that involves producing an ionized electric field through which the powder passes. The electrostatic field is produced by a high voltage source connected to a charging electrode that is installed in the electrostatic spray gun. Typically these electrodes are disposed directly within the powder path either within the spray gun nozzle or near the outlet orifice of the spray gun nozzle.

SUMMARY OF THE DISCLOSURE

In an exemplary embodiment of one or more of the inventions described herein, a powder coating system may include a powder spray gun having a spray nozzle, a dense phase pump, a supply of powder coating material and a diverter valve. The diverter valve in one embodiment provides a means by which powder flow to the spray gun can be interrupted. In another embodiment, the powder that is diverted from the spray gun may flow in a closed circulation loop back to the supply.

In another exemplary embodiment of one or more of the inventions described herein, a diverter valve is provided that has first and second selectable valve outlets.

In another exemplary embodiment of one or more of the inventions described herein, a diverter valve is provided for a powder coating system that may be used, for example, for spray coating tubular containers.

In another exemplary embodiment of one or more of the inventions described herein, a spray nozzle is provided that produces a conical spray pattern.

Exemplary methods are also presented in this disclosure, including but not limited to a method for spray coating tubular containers, with an example of such a method being embodied in the use of the described apparatus.

These and other aspects and advantages of the present invention will be apparent to those skilled in the art from the following description of the preferred embodiments in view of the accompanying drawings.

DETAILED DESCRIPTION OF THE INVENTION AND EXEMPLARY EMBODIMENTS THEREOF

Figure 1:
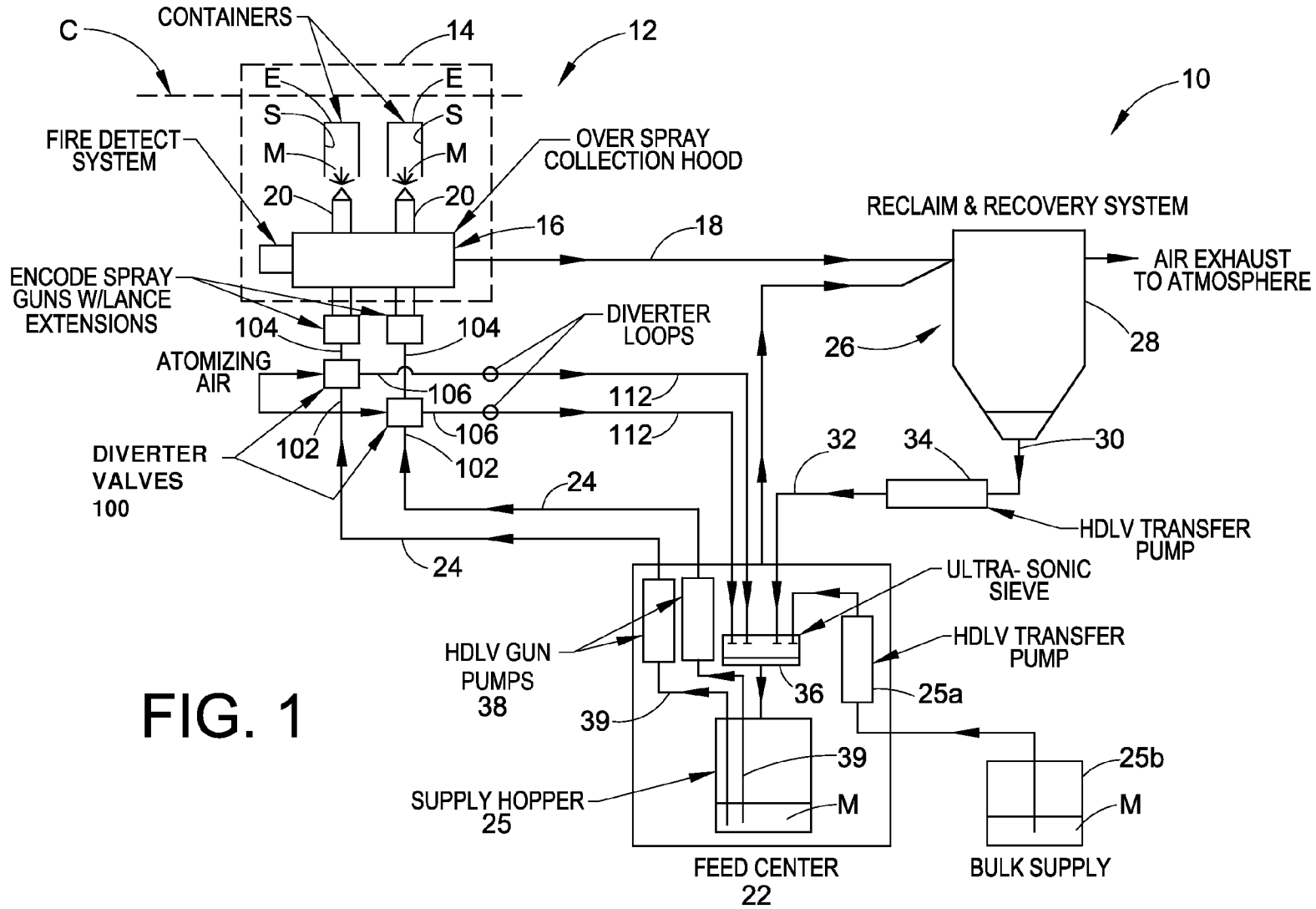
FIG. 1 is a simplified schematic diagram of an embodiment of a powder coating material application system utilizing one or more of the present inventions.

While various embodiments are presented herein in the context of a dense phase powder coating system, some aspects and inventions described herein will find application beyond dense phase applications. For example, the concept of a diverter valve as presented herein may be used in dilute phase systems and even in systems that are not powder coating systems. The embodiments described herein for a diverter valve are also exemplary in nature, there being many different ways to achieve the desired functionality described herein. And while we illustrate a specific example of dense phase pump design and other system components, the inventions herein may be used with any number of different types of dense phase pumps, spray guns, hoppers and supplies, recovery systems, spray nozzles and so on. Moreover, while the exemplary embodiments herein disclose corona-type electrostatic coating processes, the inventions herein may also be used in non-electrostatic coating processes, as well as tribocharge coating processes. Still further, while the exemplary embodiments are presented in the context of applying powder coating material to internal surfaces of a can or tubular container, the inventions may be used for coating any surfaces of a workpiece, either internal or external surfaces as well as for workpieces that are not generally cylindrical bodies, cans or tubular containers.

While the inventions are described and illustrated herein with particular reference to various specific forms and functions of the apparatus and methods thereof, it is to be understood that such illustrations and explanations are intended to be exemplary in nature and should not be construed in a limiting sense. For example, the present invention may be utilized in any material application system for applying powder coating material to a workpiece surface. The surface need not be a can surface, and need not be an interior surface, but may include exterior surfaces, generally planar, curvilinear and other surface geometries, end surfaces, and so on.

By "dense phase" is meant that the air present in the particulate flow is about the same as the amount of air used to fluidize the material at the supply such as a feed hopper. As used herein, "dense phase" and "high density" are used to convey the same idea of a low air volume mode of material flow in a pneumatic conveying system where not all of the material particles are carried in suspension. In such a dense phase system, the material is forced along a flow passage by significantly less air volume, with the material flowing more in the nature of plugs that push each other along the passage, somewhat analogous to pushing the plugs as a piston through the passage. With smaller cross-sectional passages this movement can be effected under lower pressures.

In contrast, a dilute phase flow system is a mode of material flow in a pneumatic conveying system where all the particles are carried in suspension. Conventional dilute phase flow systems introduce a significant quantity of air into the flow stream in order to pump the material from a supply and push it through under positive pressure to the spray application devices. For example, most conventional powder coating spray systems utilize Venturi pumps to draw fluidized powder from a supply into the pump. A Venturi pump by design adds a significant amount of air to the powder stream. Typically, flow air and atomizing air are added to the powder to push the powder under positive pressure through a feed hose and an applicator device. Thus, in a conventional powder coating spray system, the powder is entrained in a high velocity high volume of air, thus necessitating large diameter powder passageways in order to attain usable powder flow rates.

As compared to conventional dilute phase systems having air volume flow rates of about 3 to about 6 cfm (such as with a venturi pump arrangement, for example), the present inventions when used in dense phase systems may operate at about 0.8 to about 1.1 cfm, for example. Thus, powder delivery rates to the spray gun powder inlet may be on the order of about 150 to about 300 grams per minute. These ranges are given as an example for comparing and contrasting dense phase and dilute phase systems, and do not form any limitation on the use of the inventions disclosed herein.

Dense phase versus dilute phase flow can also be thought of as rich versus lean concentration of material in the air stream, such that the ratio of material to air is much higher in a dense phase system. In other words, in a dense phase system the same amount of material per unit time is transiting a cross-section (of a tube for example) of lesser area as compared to a dilute phase flow. For example, in some embodiments of the present invention, the cross-sectional area of a powder feed tube is about one-fourth the area of a feed tube for a conventional venturi type system. For comparable flow of material per unit time then, the material is about four times denser in the air stream as compared to conventional dilute phase systems.

While the described embodiments herein are presented in the context of a dense phase transport system for use in a powder coating material application system, those skilled in the art will readily appreciate that the present invention may be used in many different dry particulate material application systems, including but not limited in any manner to: talc on tires, super-absorbents such as for diapers, food related material such as flour, sugar, salt and so on, desiccants, release agents, and pharmaceuticals. These examples are intended to illustrate but not limit the broad application of the invention for dense phase application of particulate material to objects. The specific design and operation of the material application system selected provides no limitation on the present invention unless and except as otherwise expressly noted herein.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

With reference to FIG. 1, an exemplary powder coating system is generally indicated with the numeral 10. The system 10 may be conventional in design in terms of using basic functionality often found in powder coating systems used today, or may include less functionality or more depending on the particular system 10 being designed. The overall operation and design of the system 10 is optional based on the types of products being sprayed, run speeds, types of coating material and so on. But in general, a typical powder coating system 10 will include a coating line or machine 12 that may also include an overspray collection system 14, for example, an optional spray booth 14 represented by a dashed line box, and an overspray collection arrangement 16, such as a hood or other structure that uses suction to draw powder overspray into a recovery duct or pipe 18 or other conveyance means.

One or more spray guns 20 are used to spray coat powder coating material M onto surfaces S of the workpieces W. Typically the work pieces are presented to the spray guns 20 by a conveyor or other mover system C. As an example, the system C may include a conveyor type device that is used in part to load workpieces into a rotatable wheel, perhaps eight or ten at a time. The containers may be held for example by a vacuum chuck and spun for a coating operation. As the wheel rotates, the spray gun is lanced in and out of each container for a coating operation. Many other ways may be used to convey the containers and present them to the spray guns for coating. Each spray gun, more notably the spray nozzle (200) and a forward portion of the spray gun body such as a forward portion of the extension (60) typically are translated or lanced into the interior volume of the container for the spray coating operation. The spraying may occur while the spray nozzle is moving into the container, being withdrawn from the container or both. Those skilled in the art are familiar with many different ways that cans, containers and other workpieces may be presented to a spray gun for a coating operation, and any number of these techniques may be used with the present inventions. In this disclosure, the exemplary workpieces may be cylindrical cans, for example, and more particularly tubular containers that may optionally be closed at one end with a container end E. The ends E may be integrally formed with the container body, such as with a mono-block can, or the container may be a two or three piece container with an end welded or otherwise attached thereto as is well known in the art. In powder coating systems, a fire detection system is often provided when flammable coatings are being used particularly in electrostatic application processes.

Tubular containers, for example aerosol cans, are characterized by comparatively small diameters, for example in the range of about one to three inches, but lengths in the range of about four to twelve inches. These size examples however are not intended as any limitation on the use of the inventions disclosed herein. These narrow long bodies are difficult to uniformly coat the interior surfaces, particularly with Venturi-type spraying systems. This is because the high velocity powder and air volume produce considerable blow back. Venturi systems are also difficult to switch on and off rapidly. As a result, there can be considerable overspray and also low transfer efficiency.

The system 10 in the exemplary embodiment preferably but not necessarily is a dense phase system. Dense phase systems feature lower powder velocities and less air volume. As a consequence, by using dense phase delivery we can improve the transfer efficiency. We have also found that by using dense phase delivery we are able to provide a switching function that operates quickly to turn powder flow on and off to a spray gun without having to interrupt operation of the powder pumps. The faster switching times allow for less overspray and higher throughput. In contrast, a Venturi style dilute phase system is harder to switch because of the high velocity of the powder and the high volume of air. Venturi based systems typically utilize a vacuum source to interrupt powder flow to a spray gun nozzle but response times tend to be slow because of the large amounts and velocity of the air. Therefore, the Venturi pumps typically must be close to the spray guns, for example about four to six feet away. Venturi based systems also have the drawback of needing shorter hose runs between the supply hopper and the pumps because Venturi pumps operate by using high velocity air to suck powder from a hopper. These systems therefore have been characterized by the need to use satellite hoppers positioned closer to the spray guns than the main feed hopper back at the feed center.

Dense phase pumps on the other hand may be positioned near the feed center but can accurately pump the dense phase powder to the spray guns over long hose run lengths, for example sixty feet. This can have the benefit, for example, of facilitating plant layout where the feed centers can be conveniently positioned relative to the can coating lines.

It is common in the powder coating material application industry to refer to the powder applicators as powder spray guns, and with respect to the exemplary embodiments herein we will use the terms applicator and gun interchangeably. However, it is intended that the inventions are applicable to material application devices other than powder spray guns, and hence the more general term applicator may be used to convey the idea that the inventions can be used in many material application systems in addition to powder coating material application systems. Some aspects of the inventions are applicable to electrostatic spray guns as well as non-electrostatic spray guns. The inventions are also not limited by functionality associated with the word "spray". Although the inventions are especially suited to powder spray application, the pump concepts and methods disclosed herein may find use with other material application techniques beyond just spraying, whether such techniques are referred to as dispensing, discharge, application or other terminology that might be used to describe a particular type of material application device.

As an example, the diverter valve concepts disclosed herein would allow for using the diverter valve itself as a dispensing apparatus. For example, the output from the diverter valve could be used as a shot meter or applicator, or could alternatively be used for dispensing greater quantities during an application process.

The spray guns 20 receive powder from a feed center 22 through an associated spray gun powder feed or supply hose 24. The term "feed center" is used herein to refer to any source of particulate material suitable for use with the present inventions as are well known or later developed. The feed center 22 may include a supply hopper 25 which may serve as a main source of powder coating material in which the powder is fluidized prior to being pumped to the spray guns 20. Powder coating material M may be virgin powder meaning not previously sprayed, or reclaimed powder overspray that is recovered. Virgin powder can be added to the supply hopper either manually from bags or automatically using a transfer pump 25*a* to transfer powder from a bulk supply 25*b*, such as a box of new powder, to the supply hopper 25.

The spray guns 20 in this example may be automatic spray guns meaning that the guns are electronically or pneumatically turned on and off for coating operations, as distinguished from being manually triggered. However, those skilled in the art will readily appreciate that some inventive aspects of the disclosure, for example the spray nozzle, may be used with manual spray guns.

The automatic guns 20 typically are mounted on a support that is part of the coating line 12. The gun support (not shown) may be a simple stationary structure, or may be a movable structure, such as an oscillator that can move the guns up and down during a spraying operation, or a gun mover or reciprocator that can move the guns in and out of the collection hood 16 to translate the spray nozzle into and out of the container interior, or a combination thereof. The workpieces may also be spun during a coating operation.

The hood 16 is designed to contain powder overspray, usually by a flow of containment or entrainment air. This air flow that is drawn via the hood 16 may be effected by a powder overspray reclamation or recovery system 26. The recovery system 26 pulls air with entrained powder overspray from the hood 16, such as for example through the duct work 18. The exemplary recovery system 26 includes a cyclone separator 28 to remove much of the powder overspray that is entrained in the containment air from the hood 16. In some systems, the powder overspray is returned to the feed center 22 from the cyclone outlet 30 via a return line 32. A transfer pump 34 may be used if needed to pull recovered powder from the cyclone outlet. In this example, the transfer pump 34 pumps the recovered powder overspray to an optional sieve 36 which then returns the recovered powder to the supply hopper 25. In other systems the powder overspray may either dumped or otherwise reclaimed into a separate receptacle or hopper. The sieve 36 is commonly used as well for sieving the virgin powder from the bulk supply 25*b*.

There is provided a dense phase pump 38 for each spray gun 20. The design and operation of the pumps may be as described in the applications noted above or may be selected from different available high density pump designs well known to those skilled in the art. Dense phase is preferred for coating lines that are used to coat tubular containers as noted above. Each pump 38 draws powder from the supply hopper 25 via a pump powder inlet hose 39.

Figures 1A, 3:
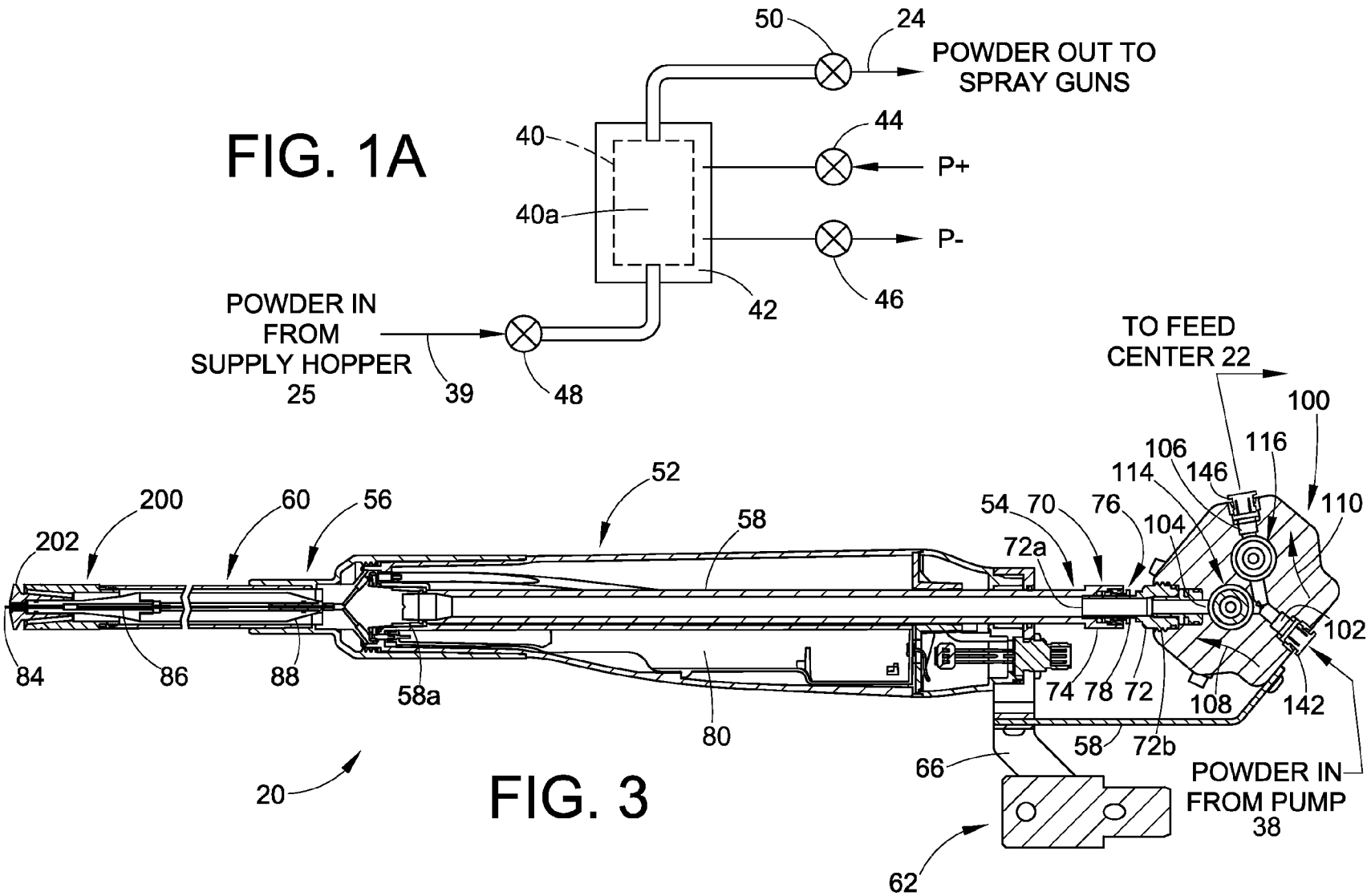
FIG. 1A is a simplified schematic representation of an embodiment of a dense phase powder pump that may be used with the present inventions.
FIG. 3 is the embodiment of FIG. 2 in longitudinal cross-section.

With reference to FIG. 1A we schematically illustrate one example of a dense phase pump such as may be used with the present inventions. Each pump may include one or more gas porous hollow cylinders 40 that each serve as a pump chamber 40*a* enclosed in a pressure chamber 42. Positive pressure $P^+$ and negative pressure or suction $P^-$ are alternately applied to the pressure chamber 42 through respective control valves 44 and 46. A powder inlet valve 48 is opened during the suction time so that powder from the supply hopper 25 is drawn into the pump chamber 40*a* via the pump inlet hose 39, after which the inlet valve 48 is closed, the outlet valve 50 is opened, and pressurized gas such as air is applied to the pressure chamber 42 which pushes powder out of the pump chamber 40*a* to the spray gun supply hose 24. A more complete description of suitable high density pump designs and operation may be obtained from the above noted publications and others, but the basic operation of alternating suction and pressure to a pump chamber to pump powder with very low added air just described is common to most high density pumps.

A control system (not shown) is commonly used with a coating system 10 and may be a conventional control system architecture such as a programmable processor based system or other suitable control circuit. The control system as is well known executes a wide variety of control functions and algorithms, typically through the use of programmable logic and program routines, which are generally indicated in FIG. 1 as including but not necessarily limited to feed center 22 control (for example hopper and sieve related controls and pump operation controls such as for the valves 44, 46, 48 and 50), spray gun 20 operation control, gun position control (such as for example control functions for the reciprocator/gun mover when used), powder recovery system 26 control (for example, control functions for cyclone separators, after filter blowers and so on), conveyor C control and material application parameter controls (such as for example, powder flow rates, applied film thickness, electrostatic or non-electrostatic application and so on). Conventional control system theory, design and programming may be utilized. As an example, the spray gun, diverter valve and pump controls may be executed with a gateway control system that interfaces with a PLC based control system used for the overall coating system such as in FIG. 1 for example. An example of a suitable gateway control to interface with a PLC type system for example, is a model iControl™ system available from Nordson Corporation, Westlake, Ohio. But this is but one example of many commercially available control systems that may be used to carryout the present inventions, or a control system may be newly designed for a particular application.

Figure 2:
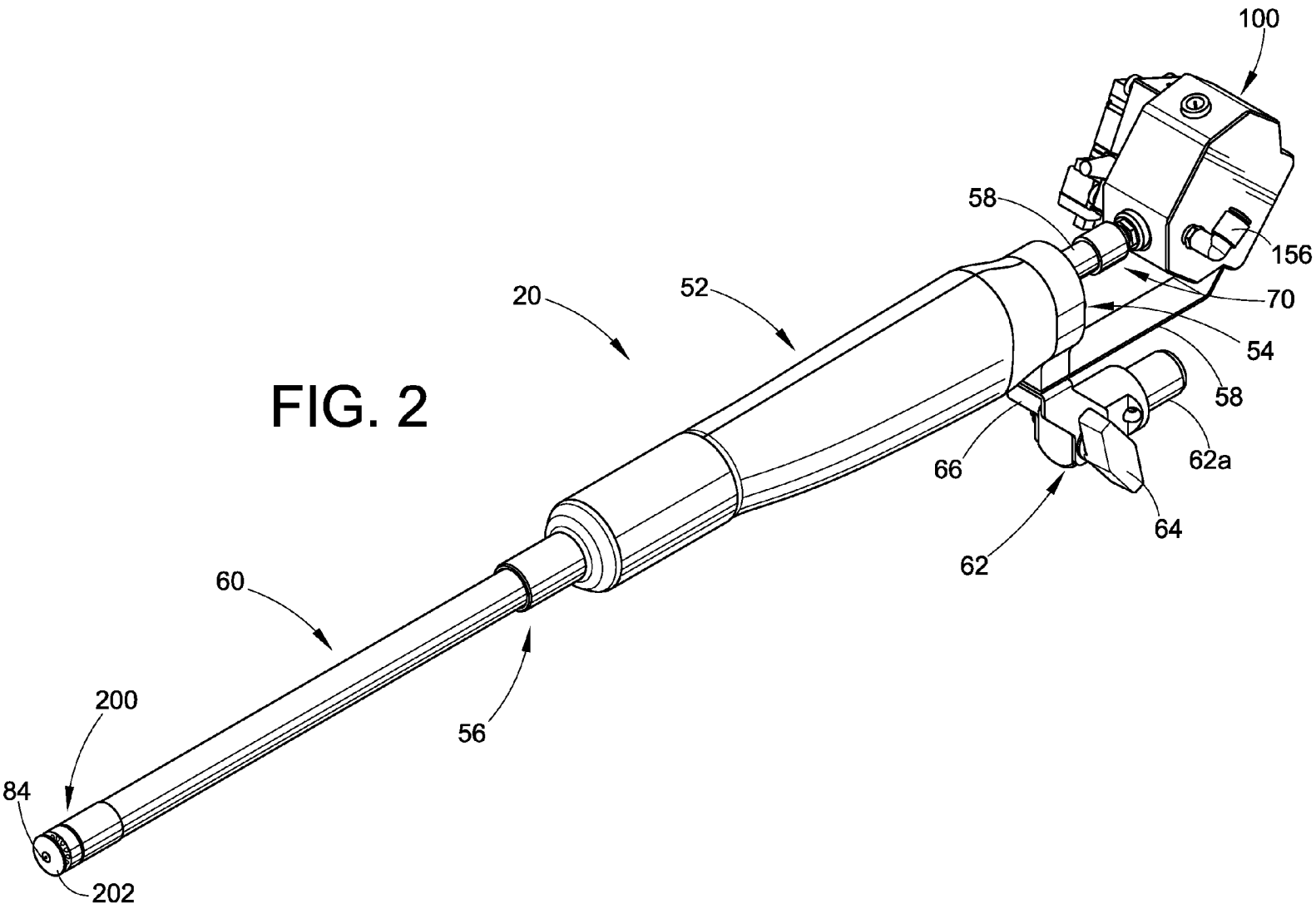
FIG. 2 is a perspective illustration of exemplary embodiments of a spray gun and diverter valve.

With reference to FIG. 2, an exemplary embodiment of an automatic spray gun 20 and diverter valve 100 in accordance with the inventions is illustrated. The same embodiment is illustrated in longitudinal cross-section in FIG. 3.

The spray applicator 20 includes a main housing 52 that encloses most of the applicator components. The housing 52 has a powder inlet end 54 and an open outlet end 56. A powder tube 58 extends substantially through the housing 52. The powder tube 58 forms a straight and uninterrupted powder path from an inlet end 54 thereof to about the outlet end 56. The powder tube 58 is preferably a single piece of tubing to minimize joints that can trap powder. This makes the applicator 20 easy to clean and purge internally. A lance or extension 60 is joined to the outlet end 56 of the main housing. The lance 60 may have a selectable length depending on the overall coating system including the geometry of the work piece W and the distance between the outside of the hood 16 to the work pieces. In this manner the main housing 52 and the diverter valve 100 need not be exposed to large quantities of powder overspray. Typical lance 60 lengths may be about ten, twelve or fourteen inches as compared to the main housing 52 which may fourteen inches or so. But longer lance 60 lengths may also be used depending on the can depth, hood size and other factors that affect the decision of how long to extend the lance 60 for a particular spraying machine. Thus the lance 60 is typically elongated compared to the main housing 52 and allows for greater flexibility when designing the coating system 10. The lance 60 may be joined to the main housing 52 by a push fit or friction fit connection, for example.

At the back end of the main housing 52 is a mounting arrangement 62 which may be used to support the spray gun 20 on a support bar 62*a* of a frame, gun mover, or other suitable structure as is well known in the art. In this example, the mounting arrangement 62 may be realized as a clamp that can be tightened and loosened with a manual adjustment knob 64. The mounting arrangement 62 may further include a bracket 66 that is attached to the back end of the spray gun 20. A diverter valve support arm or flange 68 extends or is attached to the bracket 66 to support the diverter valve 100.

The powder inlet end portion of the powder tube 58, which also serves as the powder inlet to the spray gun 20, includes an inlet end tube connector 70 that receives and retains one end of a diverter valve connector 72 having a tubular end 72*a*. A seal 74 such as an o-ring, for example, may be used to provide a fluid tight connection between the connector tubular end 72*a* and the powder tube connector end 70. The tube connector 70 may include a retention mechanism 76 to help grip and retain the tubular end 72*a* within the tube connector 70. The retention mechanism 76 may be push actuated by pushing the tubular end 72*a* into the tube connector 70, and also a release member 78 that may be push actuated to release the retention mechanism so that the tubular extension can be easily withdrawn from the tube connector 70. This would allow, for example, easy removal of the diverter valve 100 from the back end of the spray gun 20.

In this manner, the diverter valve 100 has a fluid tight and direct fluid flow path into the back end or powder inlet end 54 of the spray gun 20.

The main housing 52 may support an internal voltage multiplier 80 that receives a low voltage electrical input from an input electrical connector 82. The voltage multiplier 80 is used to provide a high voltage to an electrode tip 84 up at the nozzle end of the spray gun to ionize the air in the region of the powder spray pattern so as to electrostatically charge the powder particles as is well known in the art of corona charging. The electrode tip 84 is electrically connected to a high voltage output of the multiplier 80 by any suitable arrangement such as a high voltage cable or electrode 86, for example. The electrode 86 may be supported inside the lance 60 by any suitable means such as a spider 88 as is well known in the art.

The lance 60 includes a hollow housing 90 that supports the electrode arrangement as well as allows powder to flow from the outlet end of the powder tube outlet end 58*a* to a spray nozzle 200. The spray nozzle 200 may be threadably, press fit or otherwise attached to the distal end of the lance 60. The spray nozzle will be further described herein below, but includes an integral conical deflector 202 for producing a conical powder spray pattern. The spray nozzle 200 supports the electrode tip 84.

As an introduction to the diverter valve 100, and in view of FIGS. 1 and 3, functionally the diverter valve concept is to provide a diverter valve powder inlet 102, a first selectable diverter valve powder outlet 104 and a second selectable diverter valve powder outlet 106. By selectable is meant that powder coating material that is pumped to the diverter valve 100 may selectively be sent to the spray gun powder inlet or bypass the spray gun and be returned to the feed center 22. The selection may be performed manually or automatically under the control of the control system as needed. Thus, the diverter valve 100 provides a first selectable powder flow path 108 that is in fluid communication with the spray gun powder inlet, and a second selectable powder flow path 110 that is in fluid communication back to the feed center 22. When the diverter valve 100 is operated to communicate powder coating material back to the feed center 22, preferably the first selectable powder flow path 108 to the spray gun is blocked or obstructed, and when the diverter valve 100 is operated to communicate powder coating material to the spray gun, preferably the second selectable powder flow path 110 to the feed center 22 is blocked or obstructed.

In a first operating mode, the diverter valve 100 simply provides a first powder path 108 from the powder inlet 102 to the first selectable diverter valve powder outlet 104 to the associated spray gun 20. In a second operating mode, the diverter valve 100 blocks powder flow to the spray gun and diverts the powder flow to a second powder flow path 110 from the powder inlet 102 to the second selectable diverter valve powder outlet 106 to the feed center 22. As best understood from FIG. 1, this second operating mode of the diverter valve 100 thus provides a closed circulating loop of powder coating material from the pump 38, through the valve 100, and through a return hose 112 to the feed center 22. In this manner, when the system completes coating of a work piece, powder spraying can be quickly interrupted by switching the diverter valve 100 to the second operating mode which circulates powder coating material back to the feed center 22. This allows coating operations to be stopped without having to turn off the pump 38 or to provide a secondary outlet for the pump (such as by using vacuum to redirect powder flow or to interrupt the pump operation as when Venturi pumps are used). The diverter valve therefore ahs a much faster response time for starting and stopping coating operations.

The selection of which diverter valve powder outlet is being used at any point in time may be controlled with first and second diverter control valves 114 and 116 as further described below.

As an example, suppose a run speed of 120 cans per minute, or 0.5 seconds per can cycle time. Spraying time may be in the range of about 100-150 milliseconds with the balance of the cycle time being off time. For a Venturi type system it is difficult to immediately stop the high velocity powder flow and air volume and so there is much overspray and less control on the amount of powder transferred to the work piece. This slow shutoff also consumes much of the balance of the half second cycle time. But the diverter valve 100 can have a response time of about 30 milliseconds or less and provides a very precise powder shutoff, which allows more throughput if desired as the system does not need to use the full half second cycle time per can. The more precise on and off powder flow also provides better uniformity of the coating and less overspray.

We refer to the circulating loop as closed because there is no need for adding air or boosting pressure to the powder flow in order to circulate the powder back to the feed center 22. The same pump pressure that delivers powder to the inlet of the diverter valve 100 and the inlet to the spray gun 20 in the first operating mode of the diverter valve 100 is sufficient to return the powder flow to the feed center 22 within a closed powder flow path. A continuous circulating powder flow is thereby achieved in the second operating mode of the diverter valve 100.

In the example of FIG. 1, the powder flow path back to the feed center 22 includes the powder first going to the sieve 36 and then back into the supply hopper 25. Alternatively the diverted powder flow may bypass the sieve and return directly to the supply hopper 25.

Figures 4, 5:
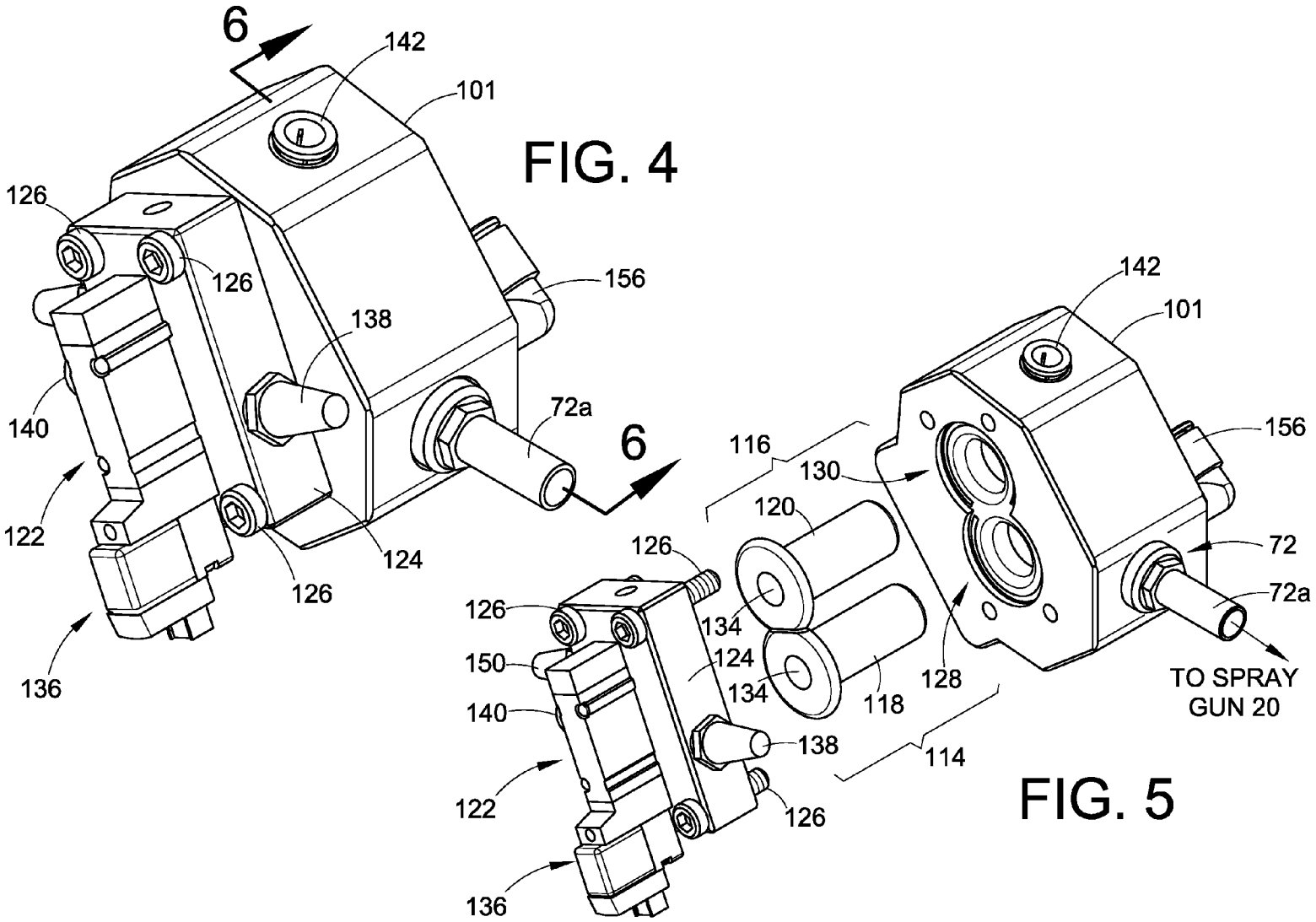
FIG. 4 is a perspective of the diverter valve in FIG. 2.
FIG. 5 is an exploded perspective of the embodiment of FIG. 4.
Figures 6, 9:
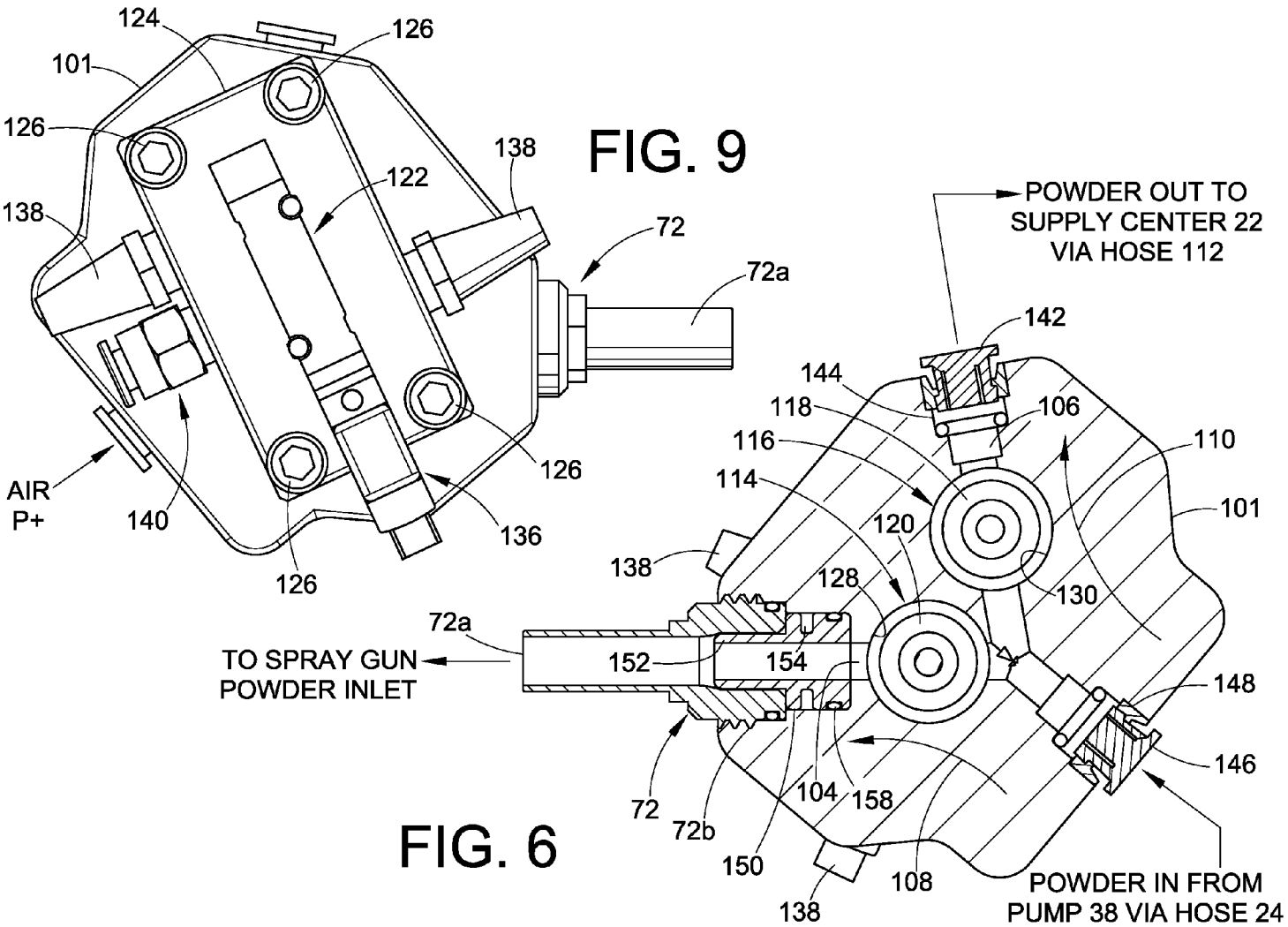
FIG. 6 is a cross-section of the diverter valve taken along line 6-6 of FIG. 4.
FIG. 9 is a side elevation of the diverter valve of FIG. 4 showing a solenoid actuated spool valve assembly.

With reference to FIGS. 4-6 we illustrate an embodiment of the diverter valve 100. In the exemplary embodiments, the diverter valve includes two control mechanisms 114, 116 that are used to select between two available powder flow paths through the valve body 101. The diverter valve may alternatively be designed to accommodate more than two selectable powder flow paths and outputs. The diverter valve 100 may also be designed with two or more powder inputs.

The control mechanisms 114, 116 in FIGS. 4 and 5 are in the nature of pneumatically actuated valve members 118, 120, and in this example may be automatically actuated based on control signals to a solenoid actuated, pneumatically driven spool valve assembly 122. An exemplary solenoid and spool valve assembly 122 is model number five port/four way valve, part no. SY3140-5M available from SMC Corporation. The type of control mechanism 114, 116 and actuator 122 used for the control mechanism may be chosen from many different options as is well known in the art. For example, in place of the spool valve 122 the valve members 118, 120 may be controlled by pneumatic inputs from an actuator other than a spool valve and could even be actuated manually. As another example, in place of the pneumatically actuated valve members 118, 120 the powder flow paths 108 and 110 can be open and closed by other mechanical means such as gate or plug or ball or needle valves. The exemplary embodiment is attractive in many applications because of the fast response time and also the small volume of dead space when the valve members 118, 120 are in the closed position.

Figure 8:
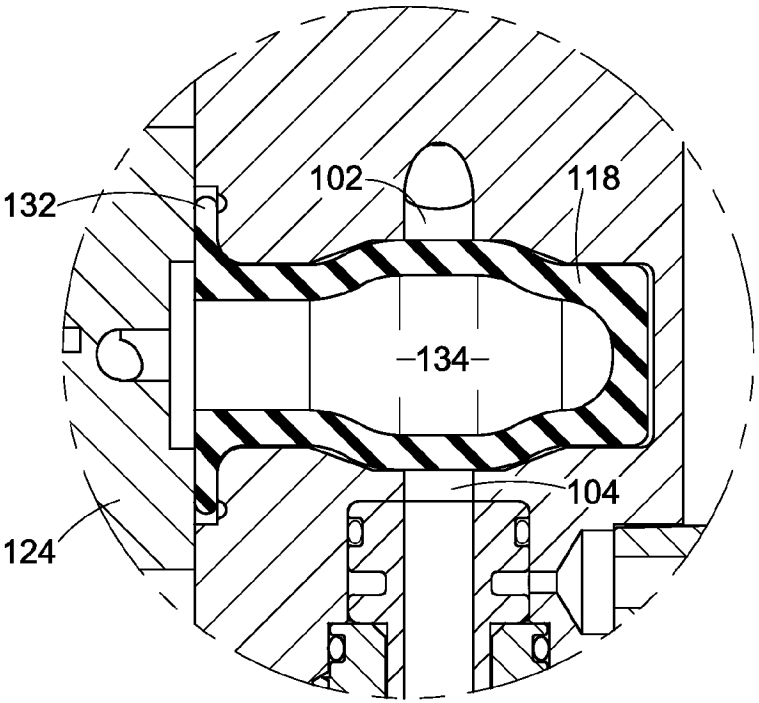
FIG. 8 is the embodiment of FIG. 7 in a pressurized or expanded condition.
Figure 7:
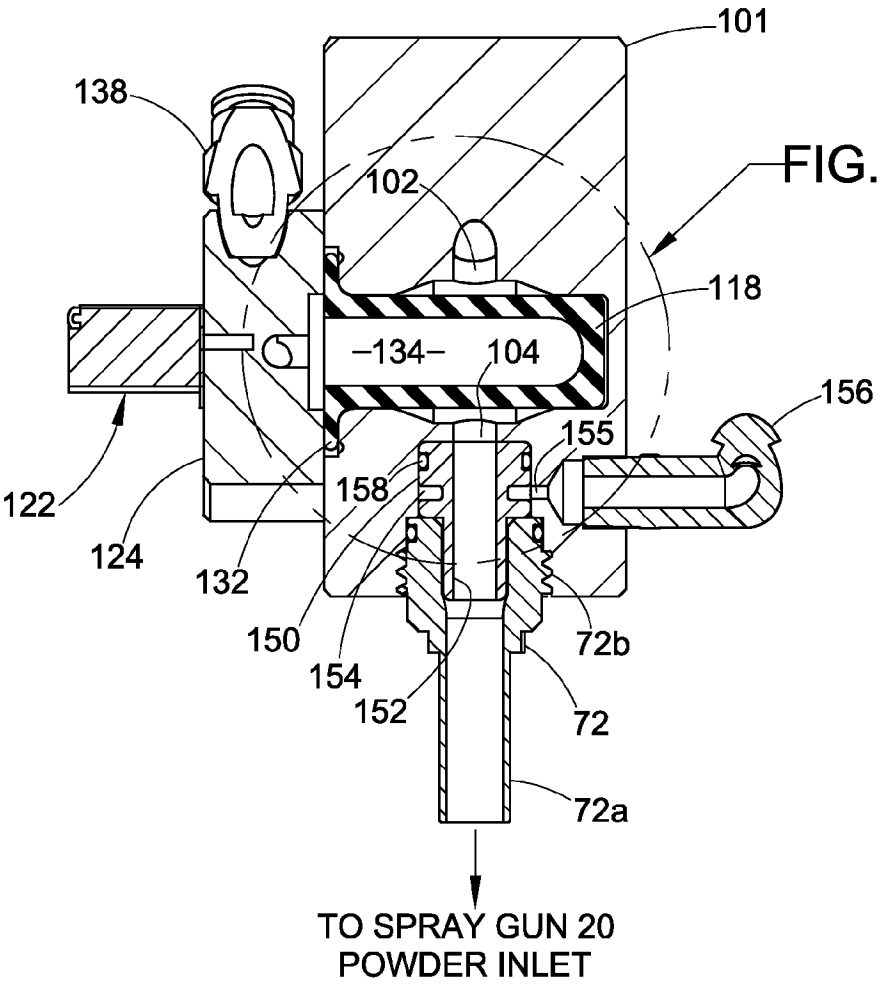
FIG. 7 is a cross section enlargement of an embodiment of one of the control mechanisms used in the diverter valve, illustrated in a relaxed or unpressurized condition.

The spool valve 122 is mounted on a cap member 124 that is mounted on the valve body 101 using bolts 126 or other suitable means. The valve body 101 has two pressure cavities 128, 130 machined therein that each closely receive a respective one of the valve members 118, 120. Each valve member 118, 120 may be in the form of single ended bladder with a seal flange 132 that is compressed between the cap 124 and the valve body 101 (see FIG. 7). Use of these bladders provides very high cycle life along with fast switching times since the spool valve 122, for example, can be actuated rapidly. Each valve member 118, 120 further includes an internal pressure volume 134 into which pressurized air can be introduced by operation of the spool valve 122. FIG. 7 illustrates the valve member 118 in an unpressurized or relaxed condition and FIG. 8 shows the valve member 118 in a pressurized or expanded condition. In the relaxed position, the powder inlet 102 is open as well as the first selectable powder outlet 104. The inlet 102 and outlet 104 are therefore in fluid communication and present the first powder flow path 108 through the valve body 101 to allow powder to flow to the spray gun inlet 54. When pressurized air is applied to the pressure volume 134, the bladder expands and blocks off or obstructs the powder flow path 108 by closing off the powder inlet 102 and the first selectable powder outlet 104. In a similar manner, the second valve member 120 is controlled and so the description need not be repeated. Of note, when either one of the powder flow paths 108, 110 is open, the other is closed off. This assures complete spray gun shutoff when the circulating loop is used via the second selectable powder outlet 106 and assures all powder flow is to the spray gun 20 when the first selectable powder outlet 104 is used. The spool valve 122 is simply actuated to admit pressurized air through an appropriate air channel (not shown) in the cap 124 to either the first valve member 118 for a spraying or coating operating mode, or to the second valve member 120 for diverting powder back to the feed center 22. A solenoid actuator 136 may be used to allow electrical control over operation of the spool valve 122, or the spool valve 122 may be actuated pneumatically or by any other suitable means. The spool valve 122 may simply include a spool that slides between two position wherein a first position pressurized air is delivered to the first valve member 118 and in the second position pressurized air is delivered to the second valve member 120. One or more mufflers 138 may optionally be used to reduce noise during operation of the spool valve 122.

To reduce overall weight the diverter valve 100 may be made of plastic materials such as molded or machined Tyvar™ for example, and the bladders 118, 120 may be made of rubber or any other suitable flexible material.

With reference to FIG. 9, pressurized air for operating the valve members 118, 120 is provided into the cap 124 via an air hose connector 140.

With reference again to FIG. 6, a powder hose connector 142 is provided in a connector port 144 and may be used to connect the diverter valve second selectable powder outlet 106 to the return hose 112 (FIG. 1) so that the second powder flow path 110 through the diverter valve 100 is in fluid communication with and forms part of the circulating loop or return powder flow path back to the feed center 22 when the diverter valve 100 is in the second mode of operation (valve 118 closed and valve 120 open). The valve connector 72 is used to provide fluid communication between the first selectable powder outlet 104 and the powder tube 58 (via the connector 70, 74 mechanism described above) that runs through the main gun housing 52. This allows the first powder flow path 108 through the diverter valve 100 to be in fluid communication with and forms part of the powder flow path to the spray gun 20 when the diverter valve 100 is in the first mode of operation (valve 118 open and valve 120 closed). Thus the diverter valve 100 forms part of a powder flow path from the supply hopper 25, through the pump 38, through the first powder flow path 108 of the diverter valve 100 into the powder tube 58 of the spray gun 20 and out the spray nozzle 200. The valve connector 72 may include a threaded end 72*b* to threadably install the connector 72 in a threaded port of the valve body 101 (see FIG. 6). This threaded connection is to facilitate the use of an option atomizing air input which will be described below.

Still with FIG. 6, a powder hose connector 146 is provided for connection to the supply hose 24 (FIG. 1) from the pump 38. This powder inlet connector 146 may be installed in a powder inlet port 148 formed in the valve body 101.

In some applications it may be desired to add atomizing air to the dense phase powder before the powder is sprayed through the nozzle 200. In the illustrated embodiment herein and reference to FIG. 7, an optional air plug 150 may be provided that includes a tube end 152 that loosely inserts into the valve connector 72 thus forming part of the powder flow path between the diverter valve first selectable powder outlet 104 and the powder inlet to the spray gun 20. The air plug 150 includes an air groove 154 that is in fluid communication with an air passage 155 in the valve body 101 to a pressurized air inlet connector 156. When atomizing air is provided via the air connector 156, the air enters the gap between the air plug tube 152 outer surface and an inner surface of the valve connector 72. This atomizing air can thus enter the powder flow stream before the powder reaches the spray gun powder inlet. A seal 158 such as an o-ring may be used to prevent powder from entering the atomizing air passage when a coating operation is being performed but atomizing air is not being used, and also to prevent back pressure on the powder flow flowing out of the first selectable powder outlet 104. The atomizing air may be controlled by a separate valve or other control device (not shown) that is triggered on when the spray gun is triggered to operate, however, in some applications it will also be desirable to have the atomizing air control be independent of the timing of the control members 118, 120, and also to have an adjustable air flow to add greater flexibility in controlling the powder spray pattern produced at the gun nozzle 200.

In another alternative, the atomizing air may be input to the powder flow path at a location within the spray gun body and even up near or at the spray nozzle.

With reference next to FIGS. 10-13 we illustrate an embodiment of the spray nozzle 200. This spray nozzle is well suited for dense phase powder spray but may also be used for dilute phase powder spray, and in either case for electrostatic and non-electrostatic applications processes. The exemplary embodiments illustrate an electrostatic version.

Figure 10:
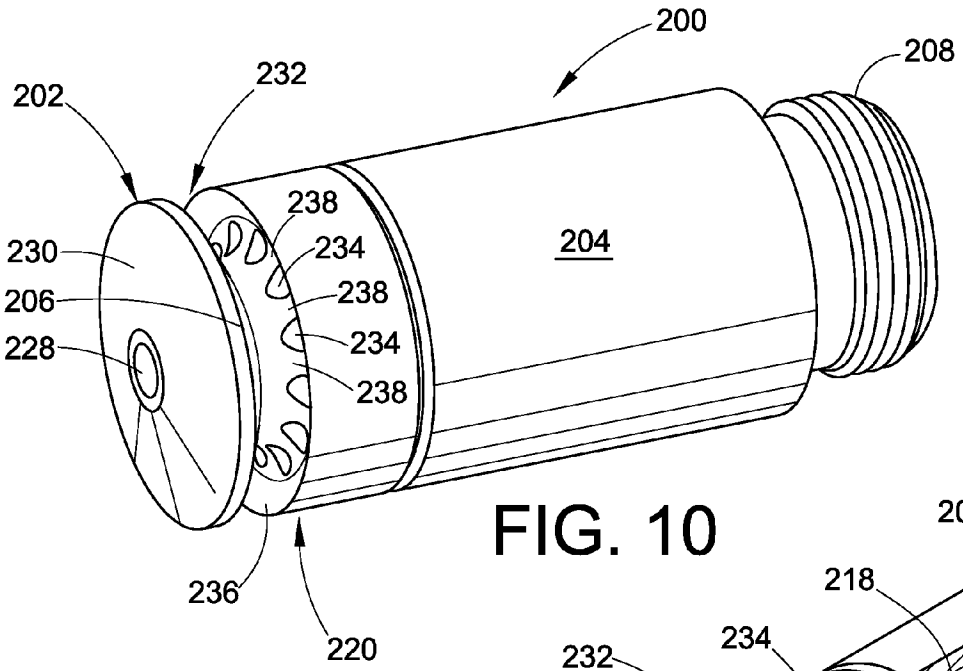
FIG. 10 is a perspective of a spray nozzle embodiment used with the spray gun of FIG. 2.
Figure 11:
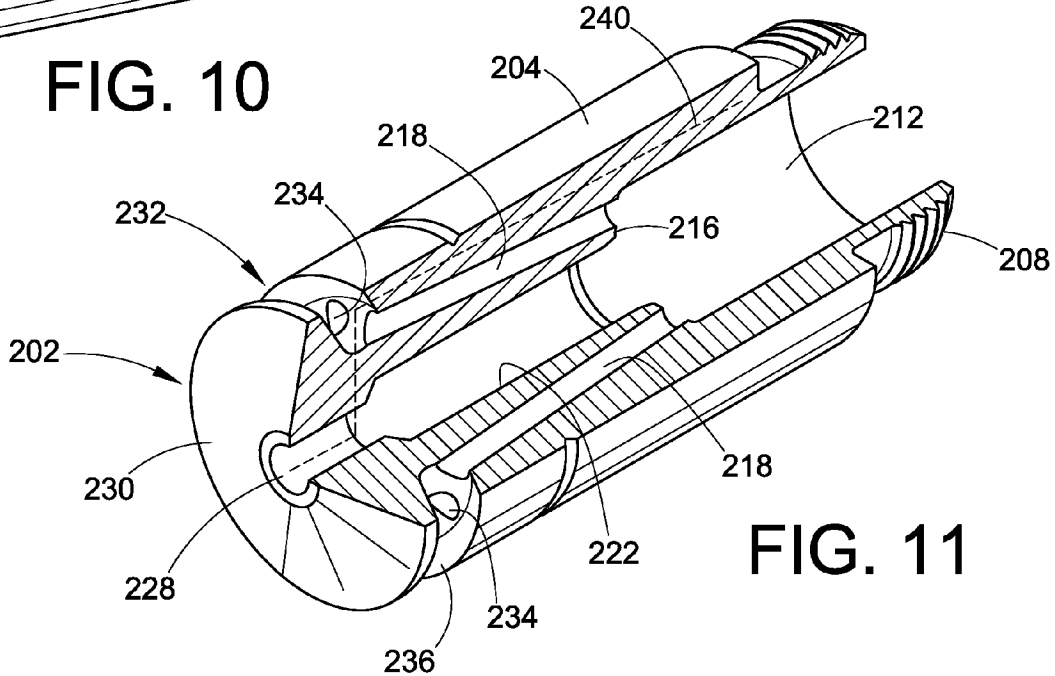
FIG. 11 is a partial longitudinal cross-section in perspective of the spray nozzle of FIG. 10.
Figure 12:
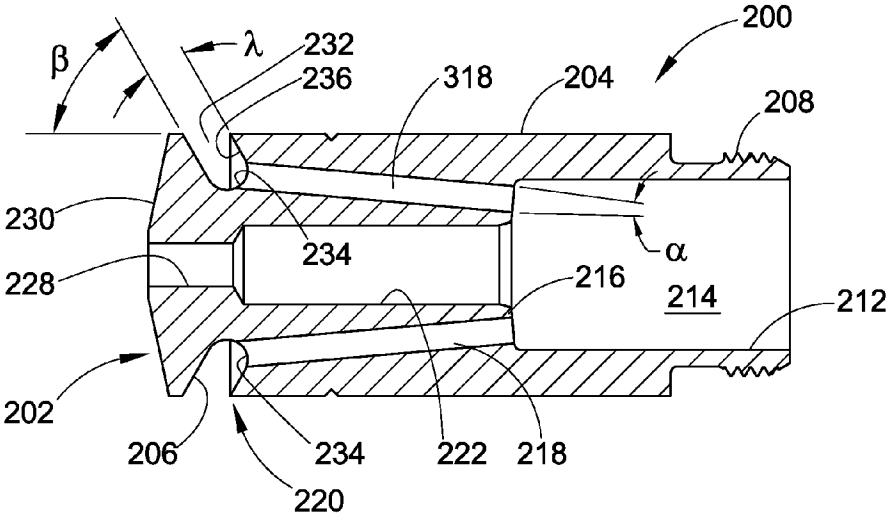
FIG. 12 is a the spray nozzle of FIG. 10 in longitudinal cross-section.

With reference to FIGS. 10 and 11, the spray nozzle 200 includes a conical deflector 202. In the exemplary embodiment herein the deflector 202 is integrally machined out of the nozzle body 204, but such is not required. A deflector may be used that is attached to the nozzle body for example.

The deflector 202 is conical in the sense that it presents a deflector surface 206 (FIG. 12) that may be frusto-conical and that causes the powder that exits the nozzle body 204 to expand outward into a conical pattern. Although the exemplary embodiment shows a frusto-conical deflector surface 206, such may not be required in all cases and the deflector surface 206 may have other contours, shapes and geometries other than being frusto-conical.

Figure 13:
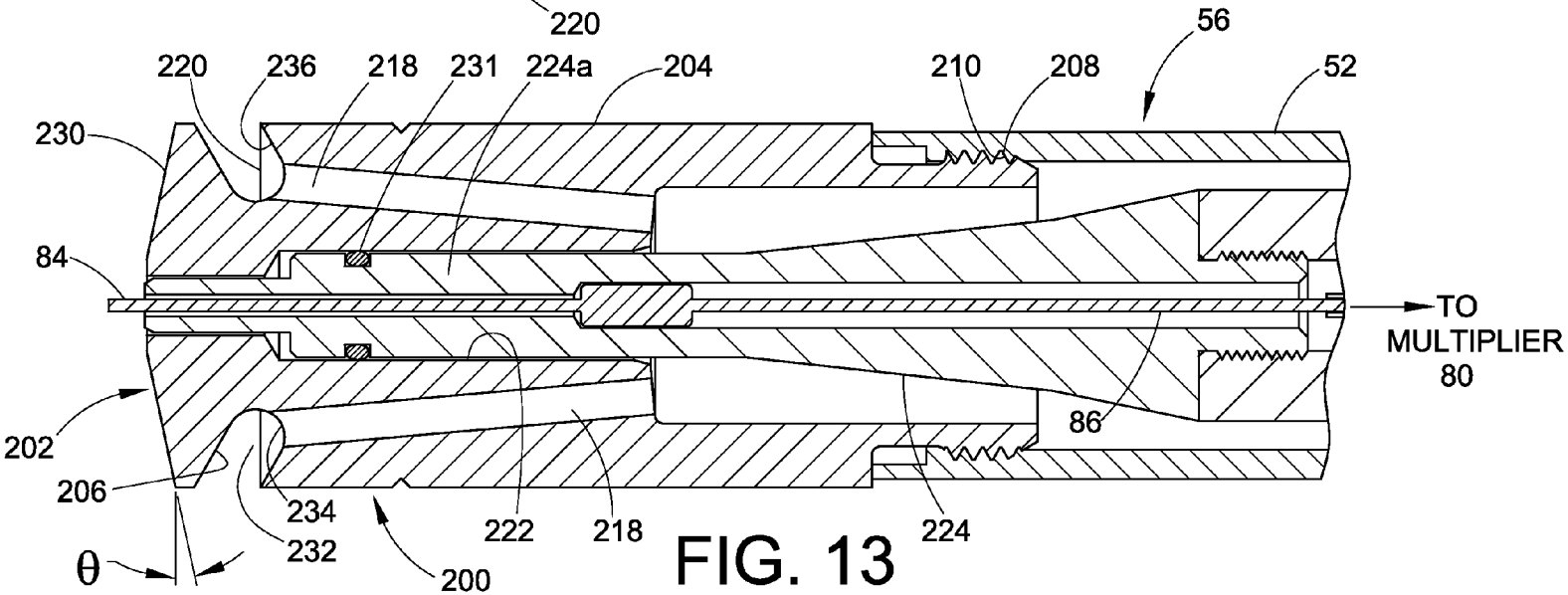
FIG. 13 is a longitudinal cross-section of the spray nozzle of FIG. 10 joined to an end of a spray gun lance and including an electrode holder embodiment.

The nozzle body 204 may include at a back end opposite the deflector 202 a threaded extension 208 which allows the spray nozzle 200 to be attached to the outboard distal end of the lance 60. FIG. 13 illustrates this exemplary threaded connection to a female threaded portion 210 of the lance 60, however, a push fit or other connection type may alternatively be used.

The nozzle body 204 includes a hollow first end or bore 212 that defines an internal volume or cavity 214. Powder coating material that enters the spray gun 20 at the powder inlet 70 flows through the powder tube 58 in the housing 52, through the lance 60 and into the nozzle body cavity 214.

Approximately halfway into the nozzle body 204 at the forward end 216 of the bore 212, a series of powder flow passages 218 are formed that extend to an outlet end 220 of the nozzle body 204. These passages 218 are preferably but not necessarily uniformly spaced circumferentially about the nozzle body 204 as best illustrated in FIG. 10. The number of passages 218 and their diameter and shape will depend on the type of spray pattern being produced which in turn depends on the type of work pieces being sprayed. We have found that for tubular containers and other can-like containers, a larger number of passages is preferred for dense phase application as this helps to slow down powder velocity and present a more diffuse powder flow to form the spray pattern. In this embodiment we use twelve powder flow passages 218 but in other applications more or fewer may be used. In general, the total cross-sectional area of the passages 218 should be equal to or greater than the cross-sectional area of the flow passage upstream of the passages 218. This avoid back pressure that could occur if the passages 218 are too small in size or number.

Each powder flow passage 218 forms a discrete flow path through the nozzle body and each is tapered outwardly at an angle $\alpha$ in order to shape a conical spray pattern. The powder will impact the frusto-conical surface 206 which may be formed at an angle $\beta$. Typical values for $\alpha$ and $\beta$ may be in the range of about 3° to about 7° and about 20° to about 90° respectively, but the actual values used will depend on the nature of the spray pattern desired.

As best illustrated in FIGS. 11 and 13, a center bore 222 may be formed in the center of the nozzle body 204. This bore may be used to insert an electrode holder 224 that supports an electrode 226. The electrode 226 is in electrical communication with the output of the voltage multiplier 80 (FIG. 3) via the high voltage cable 86. The distal end of the electrode is the electrode tip 84 (FIG. 3) noted above and may extend through an opening 228 in the conical deflector 202 so as to slightly protrude beyond the front face 230 of the deflector. The distance that the electrode tip 84 extends beyond the front face 230 will depend on the shape of the spray pattern and other factors that may influence the ability to electrostatically charge the powder particles as is known in the art.

The electrode holder 224 includes a forward portion **224*a* that preferably is close fit in the center bore 222 and may also be provided with a seal 231 such as an o-ring to prevent powder from flowing backward into the nozzle body 204. This assures as well that powder entering the internal cavity 214 flows out of the nozzle via the powder flow passages 218**.

It will be further noted that the front deflector face 230 may also be formed to have a shape other than flat, which the latter may also be used as needed. Typically though it will not be concave, but rather either convex or flat. The front face 230 may be formed at an angle $\theta$ in the approximate range of about 5° to about 20° although other angles may be used.

In order to form an integral deflector 202, a groove 232 may be milled out to a depth that exposes the flow passages 218, thereby forming a plurality of outlet holes 234. The milling operation is performed at the angle $\beta$ and with a selected width $\lambda$. Powder flow from the spray gun powder tube 58 enters the nozzle body cavity 214 and is distributed into the multiple powder flow paths 218 which may be oriented in a radial pattern about the centerline of the nozzle. As the powder exits each flow path 218 through the respective hole 234, the powder impacts the frusto-conical face 206 of the nozzle deflector 202. This change in direction mechanically shapes the powder into a conical fan pattern and directs the flow of powder to the interior walls of the work piece. The impact with the conical face 206 also helps break up the "fingers" of powder that result from the individual powder flow paths 218, thus creating a more uniform distribution of the powder coating material. The size and shape of the pattern can be varied by the changing the angle of the conical face, $\alpha$, and the width of the slot, $\lambda$.

When the groove 232 is formed, an end surface 236 of the nozzle body 204 is also formed with the plurality of holes 234 radially spaced thereon. Since the nozzle 200 has been machined from a single block of material, the conical deflector 202 is integrally supported on the nozzle body via lands 238 that are part of the end surface 236 between respective pairs of the holes 234.

It will be noted, particularly from FIG. 10, how the end surface 236 of the nozzle body 204 thereby blends with the frusto-conical surface 206 of the conical deflector 202 to form a single integral structure. Moreover, there are no structural interferences between the holes 234 and the frusto-conical surface 206. This circumferentially open groove 232 therefore avoids any dead spots in the spray pattern. As noted, the spray nozzle need not be integrally formed with the conical deflector—the deflector may be separately formed and attached to the nozzle body 204. Moreover, as an alternative to a center-run electrode support, an electrode hole 240 represented by the dashed line in FIG. 11 may be formed in the nozzle body 204 that extends through one of the lands 238 to the center bore 228 thus allowing an electrode to be run out through the nozzle body 204 to a center position such as illustrated in FIG. 13. This would avoid the need for an electrode holder 224 for example, if so desired.

Whether the conical deflector 202 is integrally formed with the nozzle body 204 or separately attached therewith, it will be desirable that there be no obstructive material between the outlet holes 234 and the frusto-conical surface 206, in other words that the groove 232 be circumferentially continuous and open between the end surface 236 of the nozzle body 204 and the frusto-conical face 206 of the conical deflector 202. It will be noted that in the exemplary The invention has been described with reference to the preferred embodiment. Modifications and alterations will occur to others upon a reading and understanding of this specification and drawings. The invention is intended to include all such modifications and alterations insofar as they come within the scope of the appended claims or the equivalents thereof.

We claim:

1. Powder coating system, comprising:

a supply of powder coating material, a powder spray gun comprising a gun housing and a spray nozzle that can be mounted on said powder spray gun housing, a pump, said pump comprising a pump chamber comprising an interior volume, a pump inlet valve and a pump outlet valve to control flow of powder coating material into and out of said pump chamber, said pump drawing powder coating material from said supply into said pump chamber when said pump inlet valve is open and said pump outlet valve is closed, and pushing powder coating material out of said pump chamber to said spray gun when said pump outlet valve is open and said pump inlet valve is closed, and a diverter valve disposed between said pump outlet valve and a powder inlet of said spray gun, said diverter valve comprising a diverter valve powder inlet for receiving powder coating material from said pump outlet valve, a first selectable diverter valve outlet that forms part of a first powder flow path from said diverter valve powder inlet to said powder inlet of said spray gun, and a second selectable diverter valve outlet that forms part of a second powder flow path, said second powder flow path being in fluid communication with said supply of powder coating material such that said second powder flow path forms a closed circulating loop from said pump to said supply of powder coating material when said second selectable diverter valve outlet is selected, an air inlet between said diverter valve powder inlet and an outlet of said spray nozzle to add air to said powder coating material before said powder coating material exits said spray nozzle, said diverter valve comprising an expandable member that blocks at least one of said first powder flow path and said second powder flow path in response to applied air pressure.

2. The powder coating system of claim 1 wherein said air inlet is an inlet to said diverter valve.

3. The powder coating system of claim 2 wherein said air inlet is disposed in said diverter valve to add air to said first powder flow path before powder coating material exits said diverter valve.

4. The powder coating system of claim 1 wherein said diverter valve comprises a second expandable member that in response to applied air pressure blocks the other of said at least one of said first powder flow path and said second powder flow path.

5. The powder coating system of claim 4 wherein said first expandable member and said second expandable member operate mutually exclusively of each other.

6. The powder coating system of claim 1 wherein said spray nozzle comprises a partially hollow cylindrical body, a first open end of said body for receiving a flow of powder coating material and an opposite end of said body comprising an end surface having a plurality of openings through which powder coating material flows from said first end and exits said body, and a deflector surface outside of said cylindrical body and joined with said end surface.

7. The powder coating system of claim 6 wherein said end surface is spaced from said deflector surface by a continuous groove.

8. The powder coating system of claim 6 wherein said deflector surface comprises a frusto-conical surface that tapers outwardly to deflect powder coating material flowing from said openings.

9. The powder coating system of claim 8 wherein said frusto-conical surface joins said end surface with lands between adjacent pairs of said openings.

10. The powder coating system of claim 6 wherein said deflector surface and said end surface are integral with each other.

11. The powder coating system of claim 1 wherein said pump chamber is defined by an interior volume of a gas permeable filter member.

12. The powder coating system of claim 1 wherein selection of said second selectable diverter valve outlet blocks said first powder flow path.

13. The powder coating system of claim 1 wherein said powder spray gun applies powder coating material to inside surfaces of a tubular container.

14. The powder coating system of claim 13 comprising an overspray collection hood and a powder overspray recovery system.

* * * * *